US007464471B2

(12) United States Patent
Fukutani et al.

(10) Patent No.: US 7,464,471 B2
(45) Date of Patent: Dec. 16, 2008

(54) RECIPROCATION TYPE ELECTRIC SHAVER

(75) Inventors: Makoto Fukutani, Hikone (JP); Takeshi Shiba, Hikone (JP); Shunsuke Komori, Omihachiman (JP)

(73) Assignee: Panasonic Electric Works, Ltd., Osaka (JP)

( * ) Notice: Subject to any disclaimer, the term of this patent is extended or adjusted under 35 U.S.C. 154(b) by 102 days.

(21) Appl. No.: 11/318,561

(22) Filed: Dec. 28, 2005

(65) Prior Publication Data

US 2006/0137187 A1 Jun. 29, 2006

(30) Foreign Application Priority Data

Dec. 28, 2004 (JP) ..... 2004-381386

(51) Int. Cl.
*B26B 19/00* (2006.01)

(52) U.S. Cl. ..... 30/43.91; 30/43.92

(58) Field of Classification Search ..... 30/43.91, 30/43.92

See application file for complete search history.

(56) References Cited

U.S. PATENT DOCUMENTS 5,548,899 A * 8/1996 Tanahashi et al. ..... 30/43.92
5,551,154 A * 9/1996 Tanahashi et al. ..... 30/43.92
6,073,348 A * 6/2000 Shiba ..... 30/43.92
6,098,288 A 8/2000 Miyagawa et al.
6,293,017 B1 * 9/2001 Sato et al. ..... 30/43.92
7,022,195 B2 * 4/2006 Otani et al. ..... 30/43.92
7,127,818 B2 * 10/2006 Sato et al. ..... 30/43.7
2004/0237310 A1 12/2004 Shiba et al.
2006/0150421 A1 * 7/2006 Sato et al. ..... 30/43.91
2007/0245565 A1 * 10/2007 Sato et al. ..... 30/43.92

FOREIGN PATENT DOCUMENTS

JP 9-253353 9/1997
WO 94/23913 10/1994

OTHER PUBLICATIONS

English Language Abstract of JP 9-253353.

* cited by examiner

*Primary Examiner*—Maurina Rachuba
(74) *Attorney, Agent, or Firm*—Greenblum & Bernstein, P.L.C.

(57) ABSTRACT

In a reciprocation type electric shaver having an outside blade unit detachable from a main body, the outside blade unit comprises a main blade, a slit blade and an outside blade holder for holding the main blade and the slit blade capable of floating up and down. A coupling structure for coupling the slit blade on the outside blade holder has a retaining structure for engaging the slit blade and the outside blade holder in a lateral direction of the outside blade unit so as to prevent disengagement of the slit blade from the outside blade holder when the slit blade is floated up and down with inclination. The retaining structure is a pair of fitting recesses formed on the slit blade and a pair of fitting protrusions formed on the outside blade holder.

7 Claims, 9 Drawing Sheets

RECIPROCATION TYPE ELECTRIC SHAVER

BACKGROUND OF THE INVENTION

1. Field of the Invention

The present invention relates to a reciprocation type electric shaver, and especially relates to a configuration of an outside blade unit.

2. Description of the Related Art

Conventionally, an outside blade unit of a reciprocation type electric shaver, for example, shown in WO94/23913 or Japanese Lid-Open Patent Publication No. 9-253353 comprises an outside blade unit configured by a main blade, a slit blade and an outside blade holder to which these blades are installed capable of freely floating up and down.

In the above conventional electric shaver, it is configured that a hooking piece formed to protrude from each end of the slit blade in longitudinal direction thereof engages with an hooking groove formed on each end wall of the outside blade holder in the longitudinal direction so that the hooking piece can be moved freely up and down.

Since the hooking piece, however, is engaged with the hooking groove only in the longitudinal direction, the slit blade may be disengaged from the outside blade holder due to shortage of hooking dimension of the hooking piece in the longitudinal direction when the slit blade is floated with inclination so that an end of the slit blade goes down lower than the other end.

Alternatively, for preventing the disengagement of the hooking piece of the slit blade from hooking groove of the outside blade holder, it is necessary to reduce a displacement of the slit blade in floating motion. In such a case, since the displacement of the slit blade in floating motion is reduced, following characteristic to concave and convex surface of skin becomes worse, so that contact feeling to the skin becomes worse, consequently.

Furthermore, even if the hooking dimension of the hooking piece in the longitudinal direction is enlarged so as not to prevent the disengagement of the hooking piece in the floating with inclination, it is necessary to make a depth of the hooking groove deeper. Consequently, the end walls of the outside blade holder in the longitudinal direction become thicker, so that the outside blade holder becomes larger. Furthermore, an area of a surface of the outside blade holder that contacts human skin may be increased, so that the contact feeling to skin becomes much worse.

SUMMARY OF THE INVENTION

The present invention is conceived to solve the problems of the above-mentioned conventional electric shaver, and to provide a reciprocation type electric shaver in which a slit blade may not be disengaged from an outside blade holder in longitudinal direction of the slit blade when the slit blade is floated with inclination so that a user can be used safely, a displacement of the slit blade in floating motion can be increased so that contact feeling to the skin can be improved, and the slit blade and the outside blade holder can be downsized so that following characteristic to a skin can be increased.

A reciprocation type electric shaver in accordance with an aspect of the present invention has an outside blade unit detachable from a main body.

The outside blade unit comprises:

a main blade configured by an outside blade having a plurality of blade holes and an inside blade which reciprocally moved in a longitudinal direction of the outside blade unit with contacting to an inner face of the outside blade;

a slit blade configured by a stationary blade having a substantially comb shape and a moving blade which is reciprocally moved in the longitudinal direction with contacting to an inside face of the stationary blade;

an outside blade holder for holding the main blade and the slit blade capable of floating up and down in a heightwise direction of the outside blade unit;

a coupling structure for coupling the slit blade on the outside blade holder in the longitudinal direction capable of floating up and down; and a retaining structure formed on the coupling structure for retaining the slit blade on the outside blade holder in a lateral direction of the outside blade unit so as to prevent disengagement of the slit blade from the outside blade holder when the slit blade is floated up and down with inclination.

By such a configuration, the slit blade is held on the outside blade holder not only in the lateral direction by the coupling structure but also in the lateral direction by the retaining structure, so that the disengagement of the slit blade from the outside blade holder can be prevented more reliably even when the slit blade is floated with inclination, in comparison with that in the conventional electric shaver in which the slit blade is held on the outside blade holder only in the longitudinal direction. Thereby, the electric shaver can be used safely, and the displacement of the slit blade in the floating motion can be enlarged so that the contact feel of the blade to user's skin can be improved. Furthermore, it is no need to lengthen the hooking dimension of the engaging structure in the longitudinal direction for preventing the disengagement of the slit blade from the outside blade holder, so that the lengths of the slit blade and the outside blade holder in the longitudinal direction can be shortened, too. Consequently, the slit blade and the outside blade holder can be downsized, so that the following characteristic of the blades to concave and convex surface of the skin is improved. Still furthermore, end portions of the slit blade and the outside blade holder in the longitudinal direction rarely touch the skin, so that the following characteristic of the blades to concave and convex surface of skin is improved much higher, and the contact feeling to the skin is increased much higher.

DETAILED DESCRIPTION OF THE EMBODIMENT

A preferred embodiment of a reciprocation type electric shaver in accordance with an embodiment of the present invention is described with reference to figures.

Figure 2A:
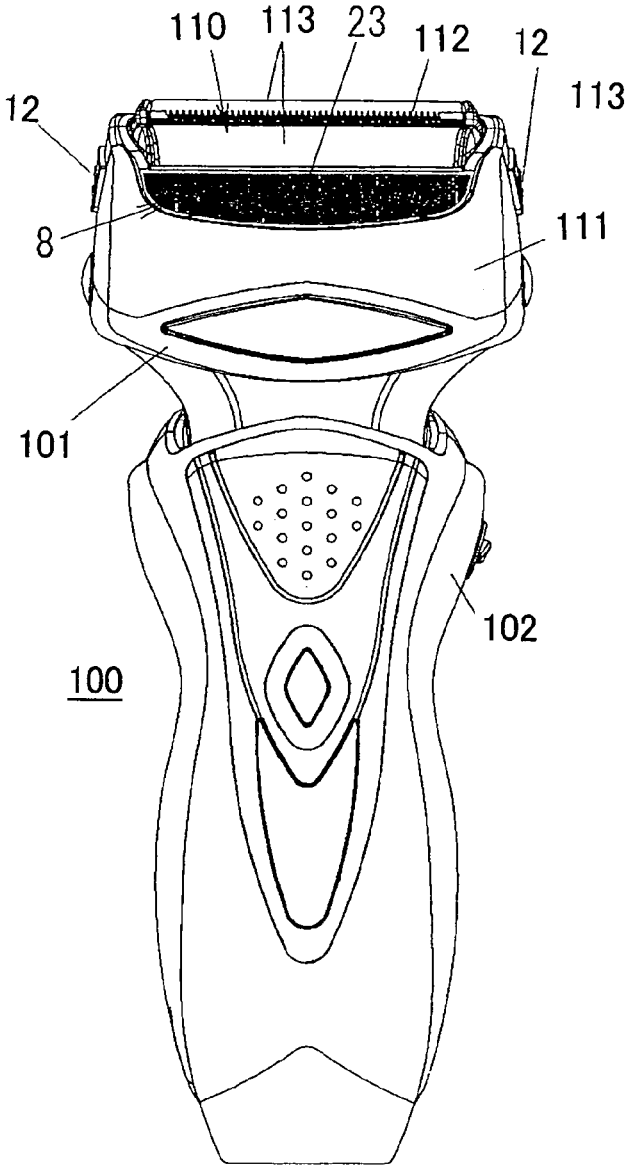
FIGS. 2A and 2B are respectively a front view and a side view of the above reciprocation type electric shaver.
Figure 2B:
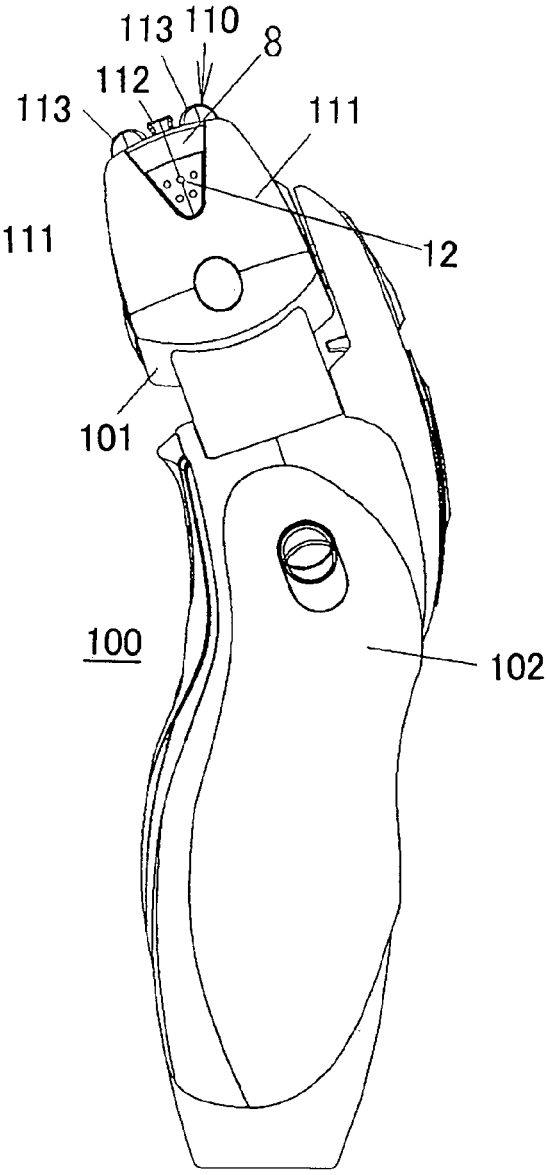

As shown in FIGS. 2A and 2B, the reciprocation type electric shaver 100 in accordance with the embodiment is configured that a head unit 101 is coupled with a main body 102 capable of swinging freely. An outside blade unit 110, which is comprised of a head cover 111, an outside blade holder 8, a slit blade 112 used for rough shaving and two main blades 113 disposed on both sides of the slit blade 112, is detachably attached to the head unit 101.

Figure 1:
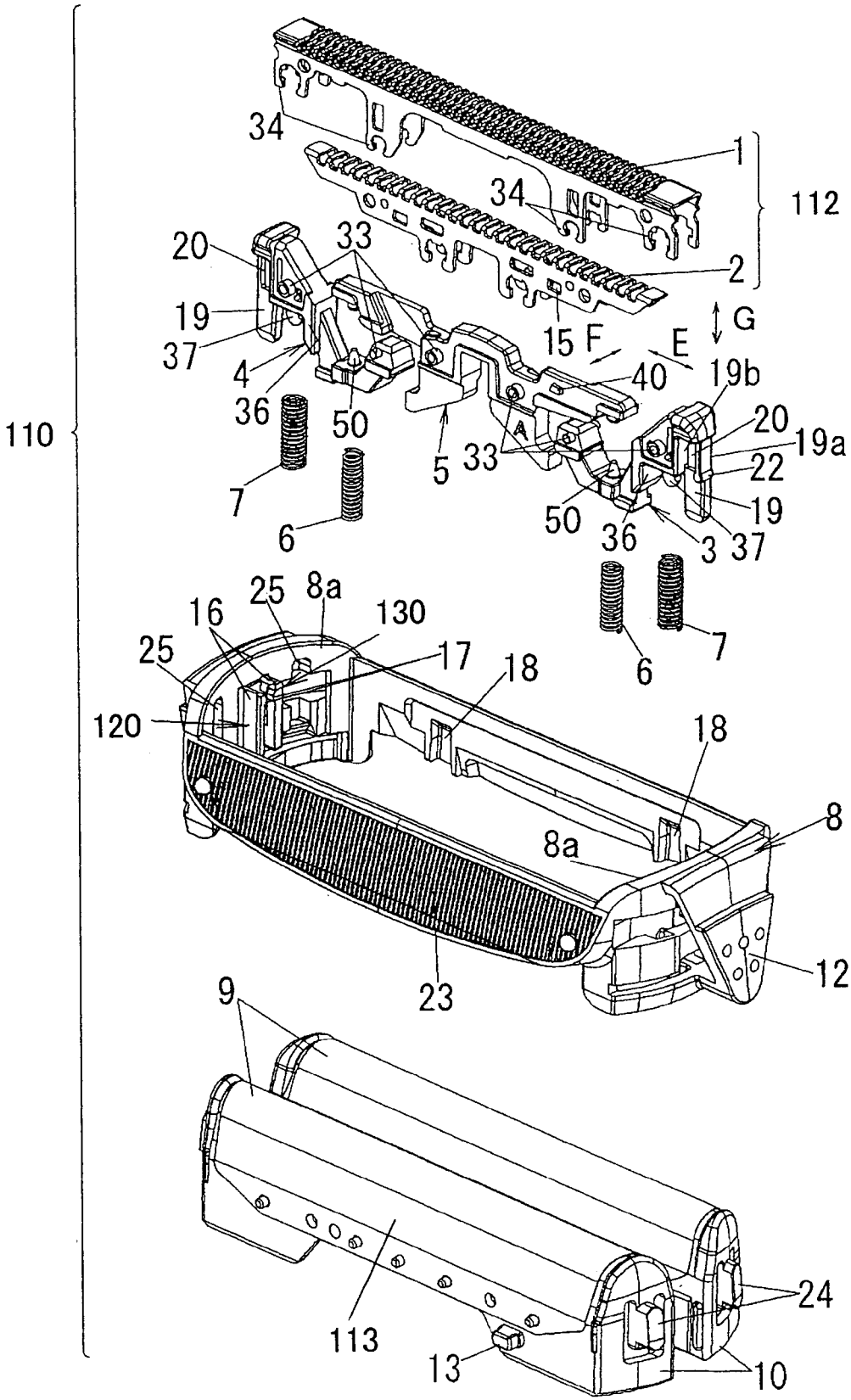
FIG. 1 is an exploded perspective view showing a configuration of an outside blade unit of a reciprocation type electric shaver in accordance with an embodiment of the present invention.

FIG. 1 shows a configuration of the outside blade unit 110. Each main blade 113 is comprised of an inside blade holder 10 and an outside blade 9 having a foil shape and attached to the inside blade holder 10. The inside blade holder 10 has engaging protrusions 13 protruded from side face thereof to be engaged with engaging recesses 18 formed on an inner side faces of an outside blade holder 8, and guide protrusions 24 protruded from both end faces in a longitudinal direction of the outside blade unit 110 to be engaged with guide grooves 25 on an inner end faces of the outside blade holder 8. The inside blade holder 10 each is fitted to the outside blade holder 8 form within so that the inside blade holder 10 each can be floated up and down with respect to the outside blade holder 8 in clearances between the guide protrusions 24 of the inside blade holder 10 and the guide grooves 25 of the outside blade holder 8.

Figure 3:
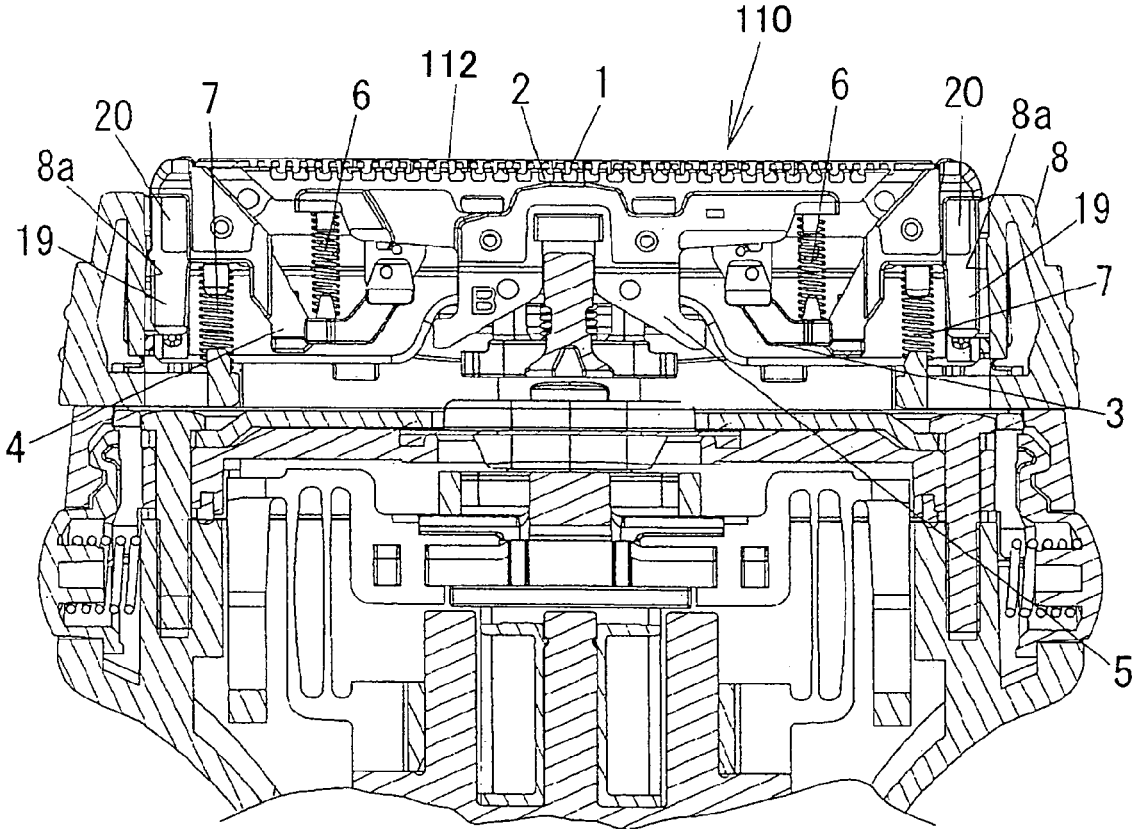
FIG. 3 is a sectional front view showing a configuration of a portion of the above reciprocation type electric shaver including the outside blade unit.
Figure 4:
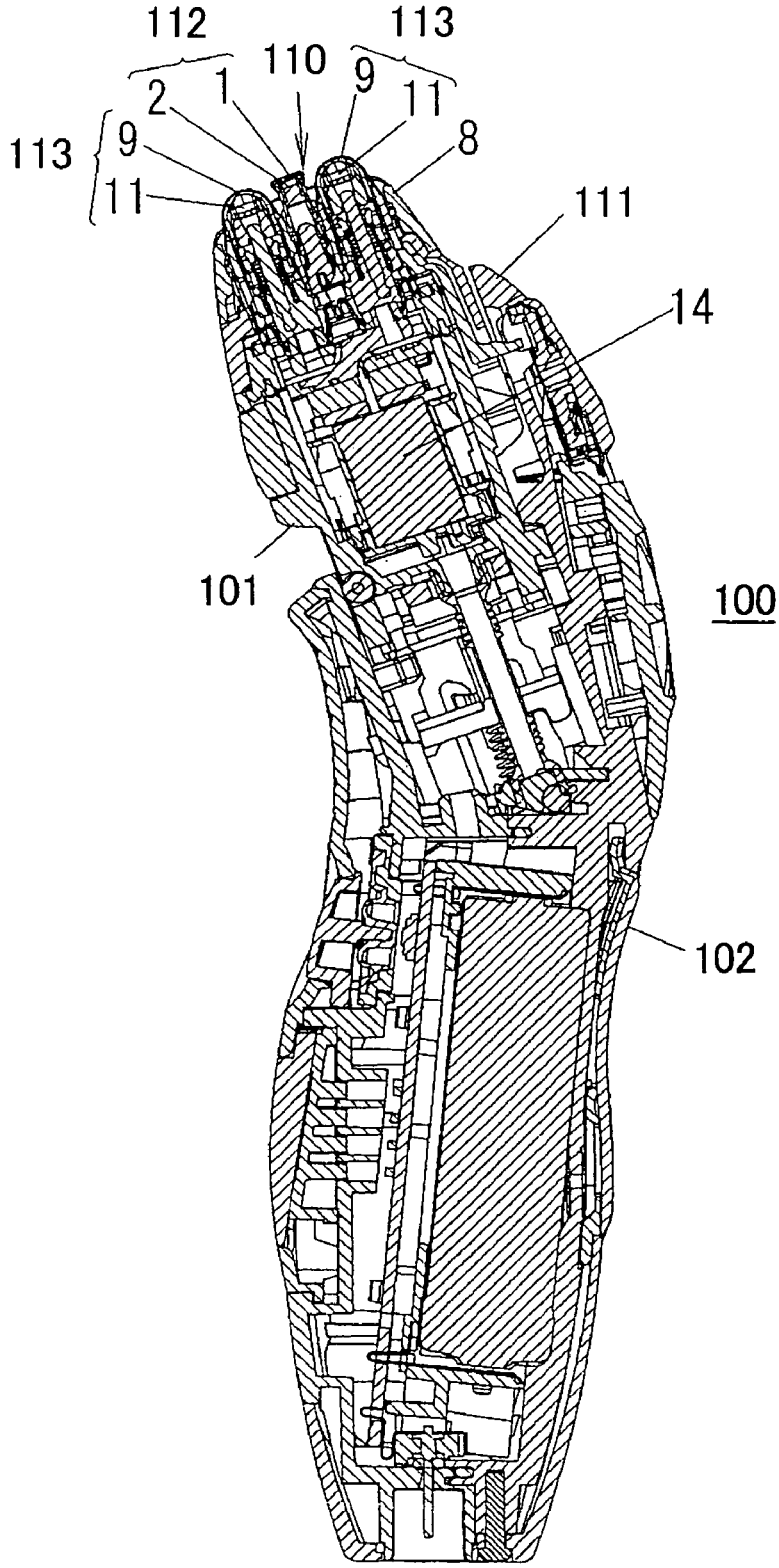
FIG. 4 is a sectional side view showing a configuration of the above reciprocation type electric shaver.
Figure 5A:
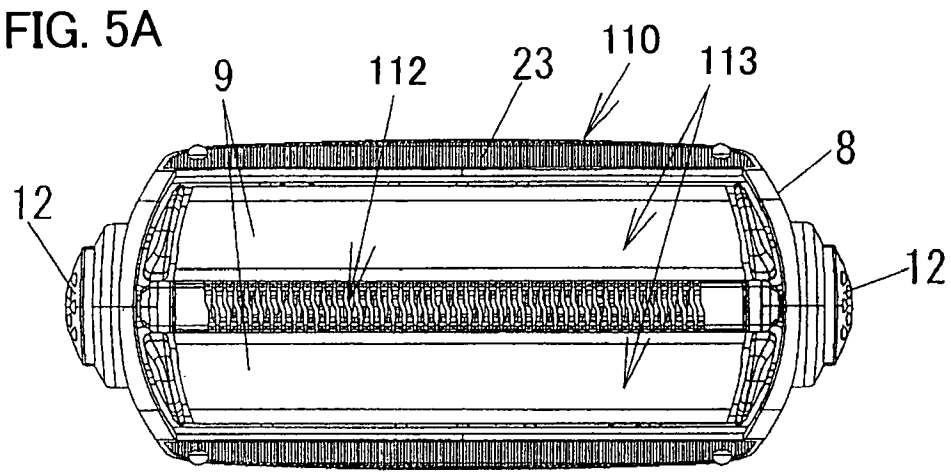
FIGS. 5A to 5C are respectively a plan view, a front view and a side view of the above outside blade unit.
Figure 5B:
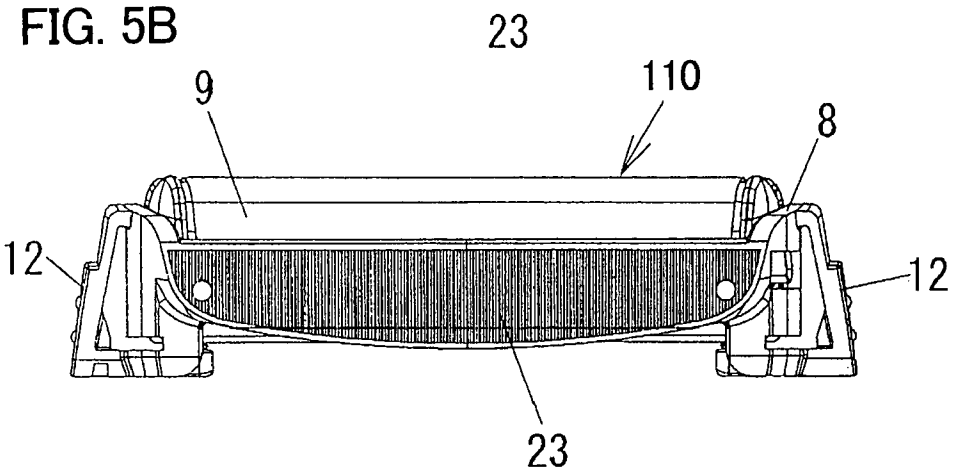
Figure 5C:
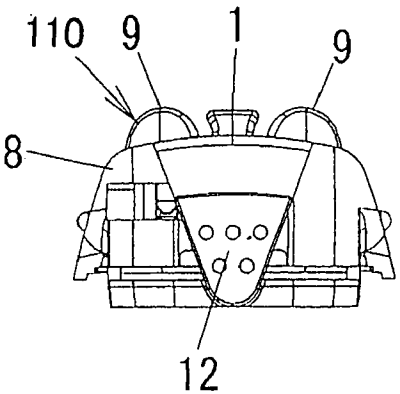

As shown in FIGS. 1 and 3, the slit blade 112 is comprised of a stationary blade 1 having a substantially comb shape and a moving blade 2 which is reciprocally moved with contacting to an inside face of the stationary blade 1. On the other hand, as shown in FIG. 4, the main blade 113 is comprised of the outside blade 9 having a lot of blade holes and an inside blade 11 which is reciprocally moved with contacting to an inside face of the outside blade 9. The slit blade 112 and the main blades 113 are respectively held on the outside blade holder 8 capable of floating up and down. Furthermore, the slit blade 112 and the main blades 113 are respectively driven in reciprocal motion by a driving force of the motor 14. The slit blade 112 is held by upward pressing forces of floating springs 6 and 7.

Figure 6:
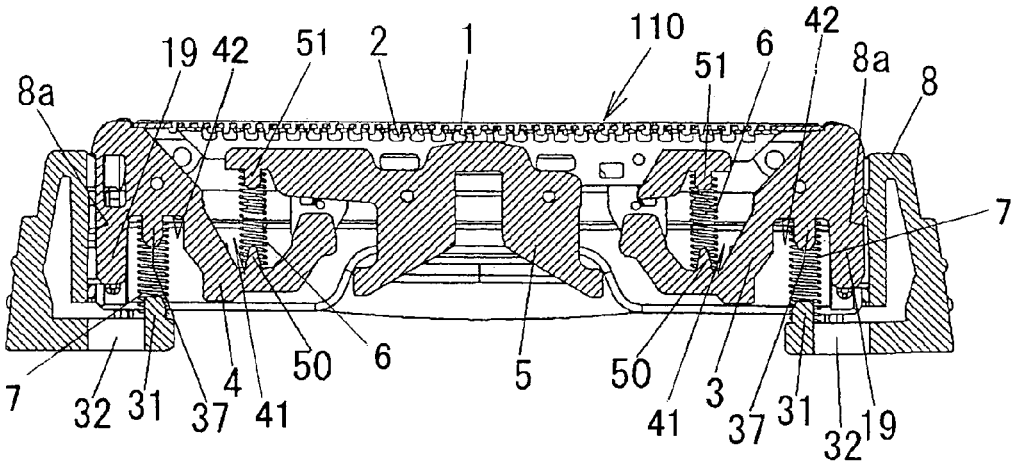
FIG. 6 is a sectional front view of the above outside blade unit.
Figure 7A:
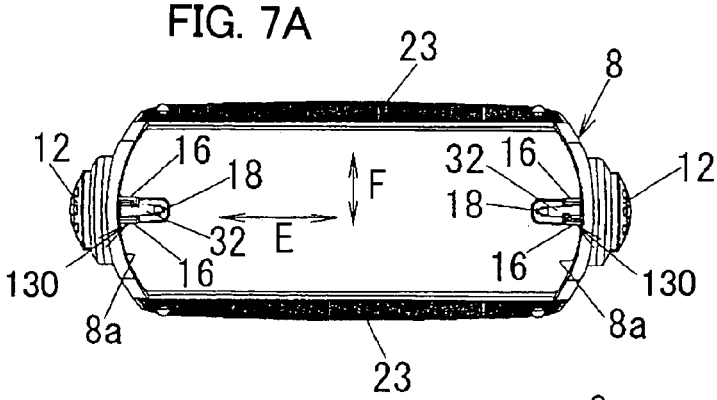
FIGS. 7A to 7C are respectively a plan view, front view and a side view of an outside blade holder of the above outside blade unit.
Figure 7B:
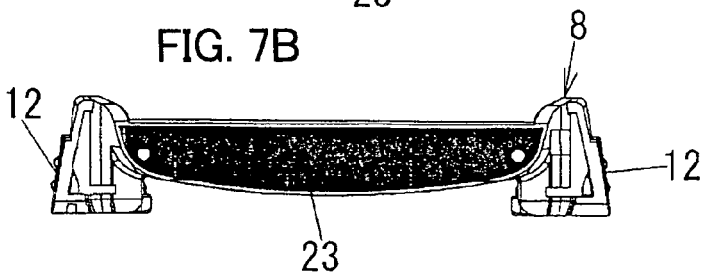
Figure 7C:
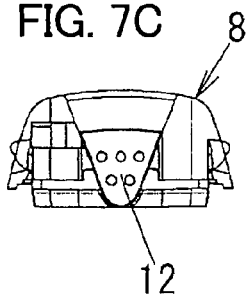

As shown in FIGS. 1, 3 and 6, a support member 5 is disposed below the stationary blade 1, and slit blade joints 3 and 4 are respectively disposed on both side of the support 5 in the longitudinal direction. Each of the support member 5 and the slit blade joints 3 and 4 has heat seal bosses 33 formed on both sides thereof. On the other hand, each of the stationary blade 1 and the moving blade 2 has plural pairs of hooks 34 formed on both sides thereof. The heat seal bosses 33 of the slit blade joints 3 and 4 are melted so that the stationary blade 1 is fixed to the slit blade joints 3 and 4 under a condition that the hooks 34 of the stationary blade 1 are engaged with the heat seal bosses 33 of the slit blade joints 3 and 4. Similarly, heat seal bosses 33 of the support member 5 are melted so that the moving blade 2 is fixed to the support blade 2 under a condition that the hooks 34 of the moving blade 2 are engaged with the heat seal bosses 33 of the support member 5.

As shown in FIG. 6, each of the slit blade joints 3 and 4 has a first spring support boss 50 formed to protrude upward from a bottom face 41 and a second spring support boss 37 is formed to protrude downward from a ceiling face 42. Similarly, a third spring support boss 51 is formed to protrude downward from both end portion of the support member 5 in the longitudinal direction. Furthermore, a pair of hooking protrusions 40 is formed at counter-cornered positions on both side faces of the supporting member 5, and hooking holes 15 are formed on both side faces of the moving blade 2 corresponding to the hooking protrusions 40. Each floating spring 6 is supported between the first spring support boss 50 of each of the slit blade joints 3 and 4 and the third spring support boss 51 of the support member 5. Thereby, a unified body of the support member 5 and the moving blade 2 is pressed to the stationary blade 1 by the pressure of the floating springs 6 and movably held in the longitudinal direction in an inner space between the stationary blade 1 and the slit blade joints 3 and 4.

Figure 9:
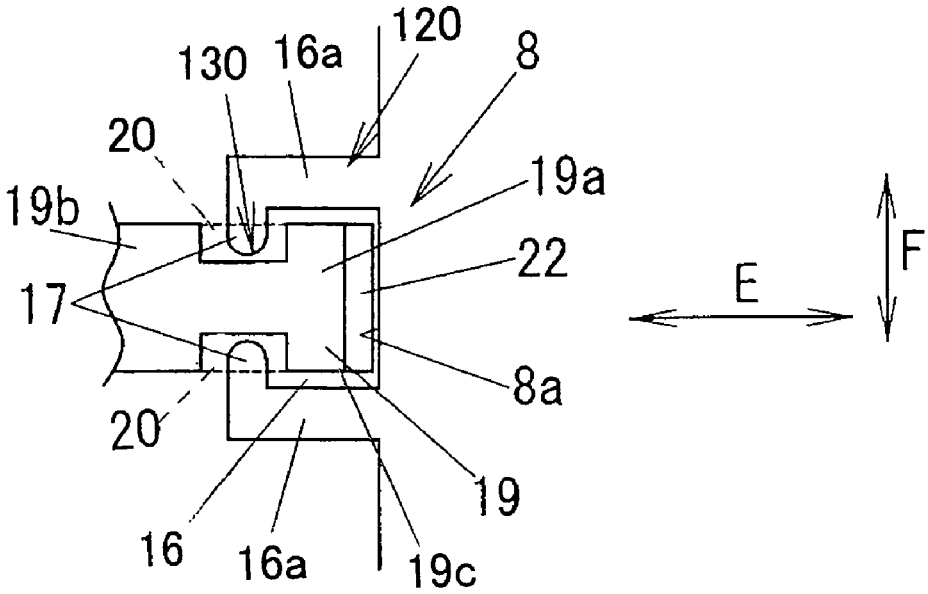
FIG. 9 is a plan view showing an engaging state of a hook and a hooking groove for preventing falling out of a slit blade from the outside blade holder.

As shown in FIGS. 1 and 6, each of the slit blade joints 3 and 4 has a hooking piece 19 protruded downward at an end facing to an inner face of the outside blade holder 8. A protrusion 22 is further formed on an outer face of the hooking piece 19 protruded outward. FIG. 9 shows a state that the hooking piece 19 is engaged with a hooking groove 16 formed on the inner face of the outside blade holder 8. When the protrusion 22 contacts with or approaching to an inner face 8*a* of the outside blade holder 8, it is possible to prevent or to reduce the rattling of the hooking piece 19 in the longitudinal direction designated by arrow E. When each of side faces 19*c* of the hooking piece 19 corresponding to the protrusion 22 in a lateral direction of the outside blade unit 110 designated by arrow F contacts with or approaching to the side wall 16*a* of the hooking groove 16, it is possible to prevent or to reduce the rattling of the hooking piece 19 in the lateral direction.

A pair of fourth spring support bosses 31 is formed to protrude upward from a bottom face of the outside blade holder 8 at positions corresponding to the second spring support bosses 37 of the slit blade joints 3 and 4. Each of the floating springs 7 is supported between the second spring support boss 37 of each of the slit blade joints 3 and 4 and the fourth spring support boss 31 of the outside blade holder 8. Thereby, the slit blade 112 which is a unified body of the stationary blade 1, the slit blade joints 3 and 4, the moving blade 2, the support member 6 and the floating springs 6 is pressed upward by the pressure of the floating springs 7, so that the slit blade 112 is held on the outside blade holder 8 capable of floating up and down. In addition, a pair of holes 32 is formed on the bottom face of the outside blade holder 8 in the vicinities of the fourth spring support bosses 31, through which shaved chips are fallen. Thereby, it is possible to prevent piling up of the shaved chips, so that the slit blade 112 can be floated smoothly.

On the other hand, as shown in FIGS. 5A to 5C, and 7A to 7C, a pair of operation buttons 12 is provided on both sides of the outside blade holder 8 in the longitudinal direction which serves as an element of an attaching and detaching structure and is used to detach the outside blade holder 8 from the outside blade unit 110. The outside blade holder 8 further has a pair of elastic frames 23 provided front and rear side thereof and elastically deformed in the longitudinal direction designated by arrow E and in the lateral direction designated by arrow F. The elastic frames 23 are deformed by pushing the operation buttons 12 from both sides in the longitudinal direction, so that the outside blade holder 8 can be detached entirely from the outside blade unit 110.

Figure 8:
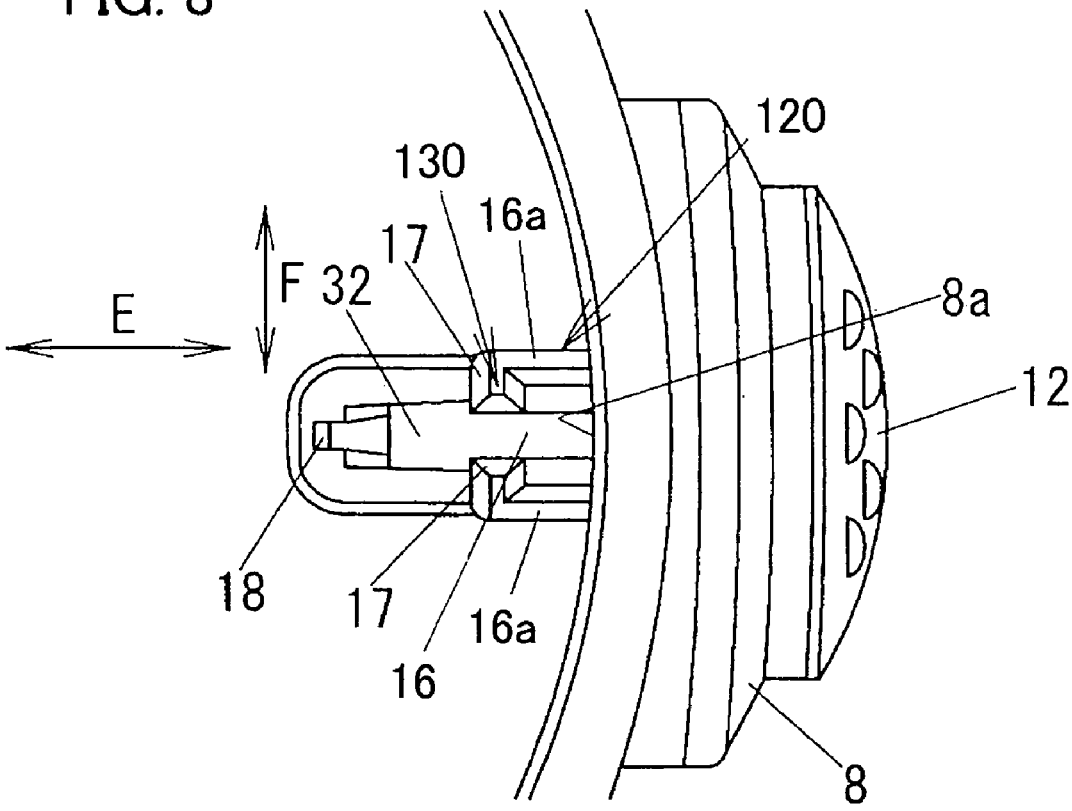
FIG. 8 is a plan view showing a detailed configuration in neighborhood of an inner wall of the above outside blade holder.

Hereupon, a coupling structure 120 for coupling the slit blade 112 on the outside blade holder 8 capable of floating up and down is configured by the hooking piece 19 formed on each of the slit blade joints 3 and 4 and the hooking groove 16 formed on the inner face 8*a* of the outside blade holder 8. As shown in FIGS. 8 and 9, a pair of side walls 16*a* constituting the hooking groove 16 is formed to protrude inwardly from the inner face 8*a* of the outside blade holder 8. A pair of fitting protrusions 17 is further formed to protrude in the lateral direction designated by arrow F for facing each other from inward ends of the side walls 16*a*. On the other hand, a pair of fitting recesses 20, which is fitted to the fitting protrusions 17, is further formed on both sides of the hooking piece 19. In this embodiment, both coupling structures 120 provided on both sides of the outside blade holder 8 in the longitudinal direction have the same configuration and arranged symmetrical with respect to the center lines of the slit blade 112 in the lateral directions. Furthermore, each coupling structure 120 is configured symmetrical with respect to the center line of the slit blade 112 in the longitudinal direction.

Figure 10:
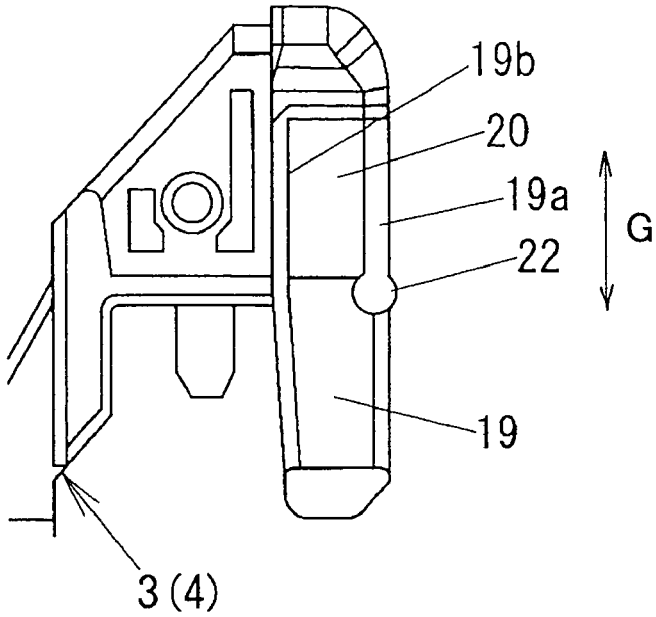
FIG. 10 is a front view showing a detailed configuration of a fixing piece having the hooking groove.

The fitting protrusions 17 formed on the outside blade holder 8 and the fitting recess 20 formed on the slit blade joints 3 and 4 serve as a retaining structure 130 for preventing the disengagement of the slit blade 112 from the outside blade holder 8 when the slit blade 112 is floated up and down, especially floated with inclination. As shown in FIG. 10, the fitting recesses 20 are formed to concave on upper half of both sides 19*c* of the hooking piece 19 of the slit joints 3 and 4 in the lateral direction designated by arrow F in FIG. 9. Each fitting recess 20 has a rectangular shape longer in heightwise when it is observed from the lateral direction. On the other hand, the fitting protrusions 17 are formed on upper ends of the side walls 16*a* of the hooking groove 16. A dimension of the fitting recess 20 is a little larger than a dimension of the fitting protrusion 17 in heightwise direction of the outside blade unit 110 designated by arrow G, so that the slit blade 112 can be floated up and down with respect to the outside blade holder 8 by a difference between the dimensions of the fitting recess 20 and the fitting protrusion 17.

Figure 11:
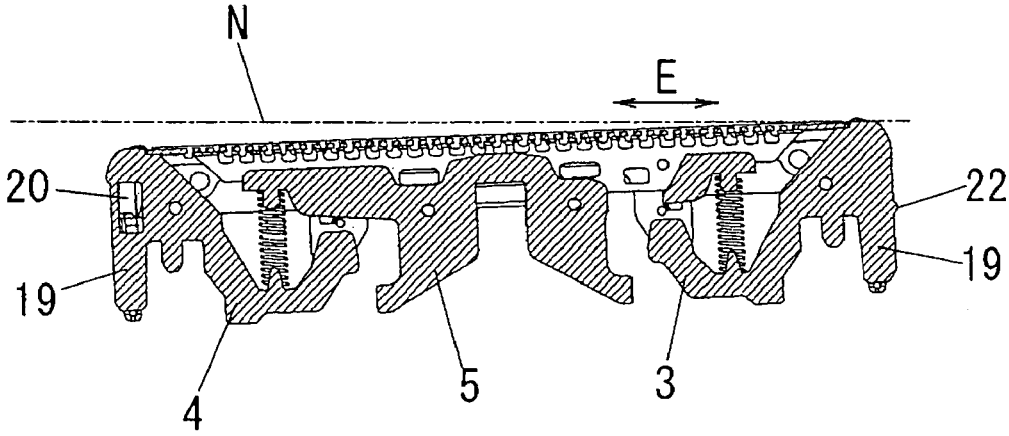
FIG. 11 is a sectional front view showing a floating condition of the slit blade with inclination.

Furthermore, as shown in FIG. 9, the fitting protrusions 17 are fitted to the fitting recesses 20 in the lateral direction shown by arrow F, it is possible to prevent the disengagement of the hooking piece 19 from the hooking groove 16 even when the slit blade 112 is floated with inclination. Hereupon, a state that the slit blade 112 is floated with inclination is shown in FIG. 11. In FIG. 11, one dotted chain line N designates a reference line when the slit blade 112 is not floated, that is the slit blade 112 is parallel to the upper edge of the outside blade holder 8. When the slit blade 112 contacts a human skin only at a position in the vicinity of an end thereof, the end of the slit blade 112 goes down from the other end. Since the fitting recess 20 is enclosed by side walls, side faces of the fitting protrusion 17 contact the side walls of the fitting recess 20 when the slit blade 112 is floated with inclination. Therefore, it is possible to prevent the disengagement of the slit blade 112 from the outside blade holder 8.

As mentioned above, the disengagement of the slit blade 112 from the outside blade holder 8 in the longitudinal direction designated by arrow E can be prevented by hooking of the hooking pieces 19 of the slit blade joints 3 and 4 with the hooking grooves 16 of the outside blade holder 8. Furthermore, the disengagement of the slit blade 112 from the outside blade holder 8 in the lateral direction designated by arrow F can be prevented by fitting of the fitting protrusions 17 formed on the side walls 16*a* of the hooking grooves 16 and the fitting recess 20 formed on the hooking pieces 19. Still furthermore, the fitting protrusions 17 and the fitting recesses 20 can serve as a retaining structure for preventing the disengagement of the slit blade 112 from the outside blade holder 8 upward in the heightwise direction designated by arrow G. Therefore, the slit blade 112 is rarely disengaged from the outside blade holder 8 even when the slit blade 112 is floated with inclination, so that it is possible to increase the displacement of the slit blade in the heightwise direction. Consequently, it is possible to improve the contact feeling to the skin. Furthermore, the hooking dimension of the hooking piece 19 in the longitudinal direction can be shortened, so that the lengths of the slit blade 112 and the outside blade holder 8 in the longitudinal direction can be shortened, too. Consequently, the slit blade 112 and the outside blade holder 8 can be downsized, so that the following characteristic of the blades to concave and convex surface of skin is improved, and the contact feeling to the skin is increased higher. Still furthermore, end portions of the slit blade 112 and the outside blade holder 8 in the longitudinal direction rarely touch the skin, so that the following characteristic of the blades to concave and convex surface of skin is improved much higher, and the contact feeling to the skin is increased much higher.

As can be seen from FIGS. 9 and 10, side walls 19*a* and 19*b* of the fitting recess 20 are formed to protrude in the lateral direction designated by arrow F, in other words, the thickness of the hooking piece 19 in the lateral direction is partially made thicker, so that the mechanical strength of the hooking piece 19 is increased. Consequently, the rigidity of the entire of the slit blade 112 can be ensured, so that it is possible to reduce the impact to the slit blade 112 even when the electric shaver 100 is fallen. Furthermore, since the warp of the slit glade 112 entirely in the lateral direction designated by arrow F during the shaving is further restricted by the increase of the rigidity of the hooking piece 19, the slit blade 112 can be floated smoother, and gaps between the slit blade 112 and the main blades 113 can be maintained even. Consequently, it is possible to prevent that the blade cuts into the skin deeper.

When the operation buttons 12 of the outside blade holder 8 is inwardly pushed in the longitudinal direction by fingers, the outside blade holder 8 is elastically deformed, so that it is easily detached from the head cover 111. Thereby, the slit blade 112 and the main blades 113 can be washed or replaced, easily. Furthermore, the impact applied to the blades due to falling of the electric shaver can be reduced by the elasticity of the outside blade holder 8. Still furthermore, it is possible to prevent the spill of the shaved chips from both sides of the outside blade holder 8 in the longitudinal direction by the elasticity of the outside blade holder 8.

Furthermore, since two fitting protrusions 17 are formed on each hooking groove 16 for facing each other in the lateral direction, the disengagement of the hooking piece 19 from the hooking groove 16 can be prevented by the fitting protrusions 17 in both of the longitudinal direction and in the lateral direction. Thereby, the effect for preventing the disengagement of the slit blade 112 from the outside blade holder 8 can be increased much higher. Still furthermore, when the slit blade 112 is attached to the outside blade holder 8, the fitting protrusions 17 serve as positioning guide of the fitting pieces 19 of the slit blade joints 3 and 4 disposed at both sides of the slit blade 112 in the longitudinal direction, so that the hooking pieces 19 are evenly inserted into the hooking grooves 16 on the both sides of the outside blade holder 8. Consequently, plastic deformation of the hooking pieces 19 and/or the side walls 16*a* of the hooking grooves 16 can be prevented. Still furthermore, the inclination of the slit blade 112 with respect to the outside blade holder 8 when the slit blade 112 is attached to the outside blade holder 8 can be reduced, so that the floating springs 7 can easily and simultaneously attached between the silt blade 112 and the outside blade holder 8. Consequently, the assemble workability of the outside blade unit 110 of the electric shaver can be increased.

Figure 12A:
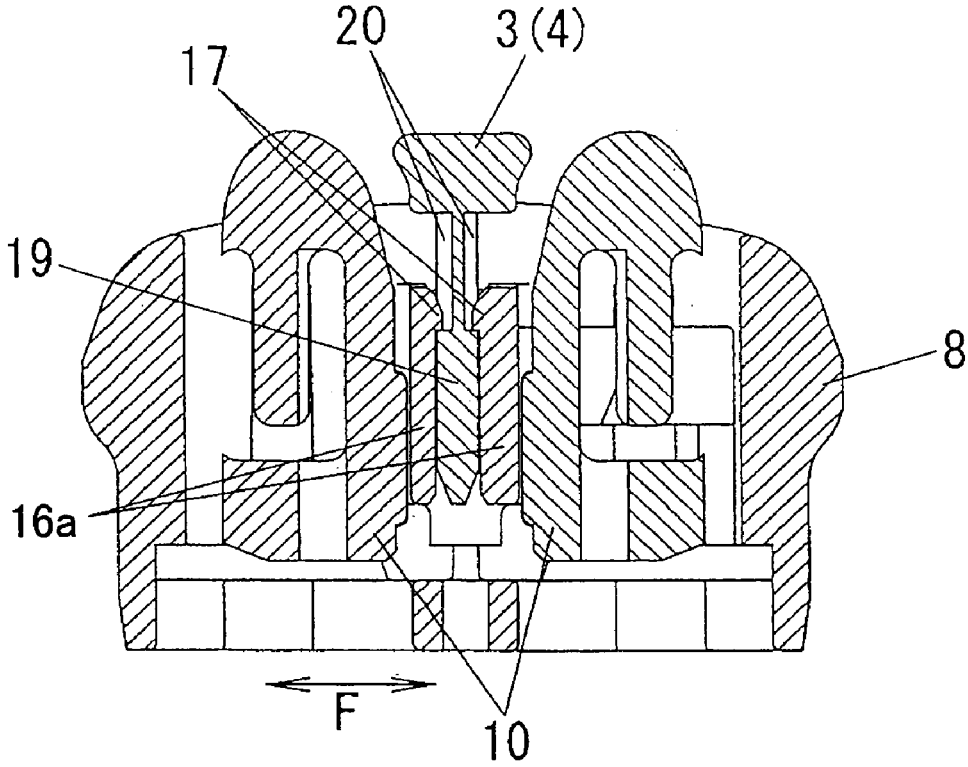
FIG. 12A is a sectional side view showing a state of an end portion of the outside blade unit in the floating state of the slit blade with inclination.
Figure 12B:
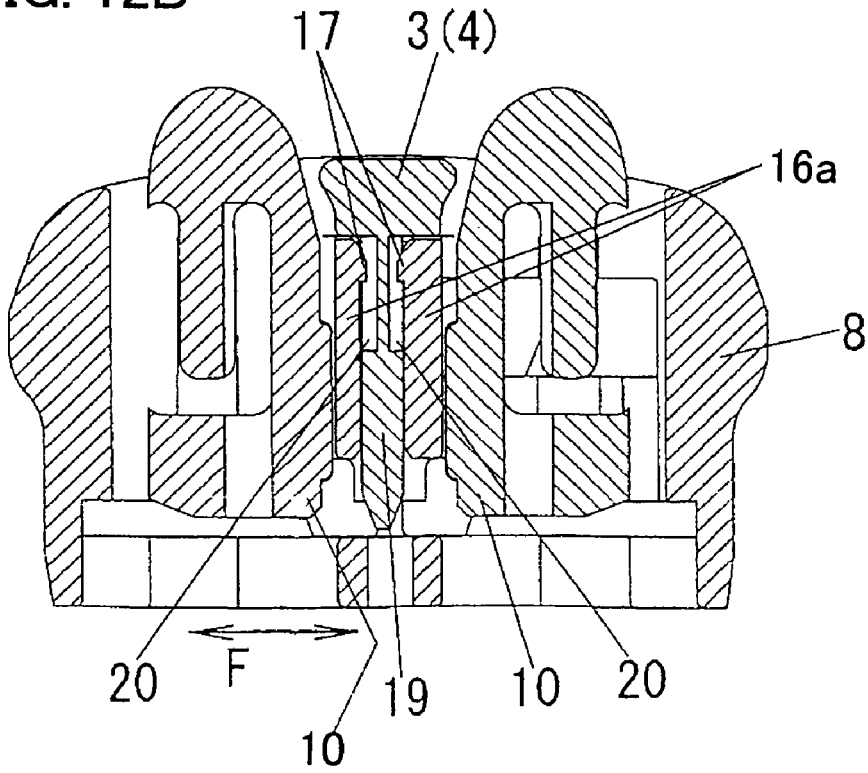
FIG. 12B is a sectional side view showing a state of the other end portion of the outside blade unit in the floating state of the slit blade with inclination.

As shown in FIGS. 12A and 12B, it is possible that the inside blade holders 10 which hold the outside blades 9 of the main blades 113 are contacted to both side walls 16*a* of the hooking grooves 16. Thereby, the elastic deformation of the side walls 16*a* of the hooking grooves 16 due to the floating motion of the slit blade 112. Consequently, the rattling of the slit blade 112 can be prevented. Furthermore, the deformation of the coupling structure 120 of the outside blade holder 8 including the hooking grooves 16 due to creep can be prevented, even when stress is repeatedly applied to the side walls 16*a* of the hooking grooves 16 in the lateral direction while the slit blade 112 is floated in the shaving. Thereby, the disengagement of the slit blade 112 from the outside blade holder 8 can be prevented more reliably.

Still furthermore, it is possible to form a chamfer flatly or roundly on hooking face of the slit blade 112 and the outside blade holder 8, for example, lower edges of the hooking piece 19. Thereby, the chamfer serves as a guide to reduce the displacement of the hooking pieces 19 with respect to the hooking grooves 16 when the slit blade 112 is attached to the outside blade holder 8. Consequently, the assemble workability of the outside blade unit 110 of the electric shaver 100 can be increased. Still furthermore, it is possible to prevent that the appearance of the outside blade holder 8 is damaged while the outside blade unit 110 is assembled.

In the above-mentioned embodiment, the outside blade unit 110 having one slit blade 112 and two man blades 113 is described as an example. The numbers of the slit blade 112 and the main blade 113 are not limited to the above description. It is possible to constitute the outside blade unit to have, for example, one slit blade and one main blade.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A reciprocation type electric shaver having an outside blade unit detachable from a main body, the outside blade unit comprising:

a main blade configured by an outside blade having a plurality of blade holes and an inside blade which reciprocally moves in a longitudinal direction of the outside blade unit to contact an inner face of the outside blade;

a slit blade configured by a stationary blade having a substantially comb shape and a moving blade which reciprocally moves in the longitudinal direction to contact an inside face of the stationary blade such that the slit blade is configured to float up and down in a direction transverse to the reciprocation direction of the outside blade unit;

an outside blade holder to hold the main blade;

a coupling structure to couple the slit blade on the outside blade holder in the longitudinal direction capable of floating up and down; and a retaining structure configured to engage the slit blade with the coupling structure on the outside blade holder in a lateral direction of the outside blade unit so as to prevent disengagement of the slit blade from the outside blade holder when the slit blade floats up and down with inclination, the retaining structure being defined by a pair of fitting recesses provided on the slit blade and a pair of fitting protrusions provided on the coupling structure and protruding in the lateral direction facing each other, and the pair of fitting protrusions of the coupling structure configured to engage the pair of fitting processes of the slit blade in a plane defined by the longitudinal direction and the lateral direction.

2. The reciprocation type electric shaver in accordance with claim 1, wherein the outside blade unit further comprises an attaching and detaching structure by which the outside blade holder is attachable to the outside blade unit and detachable from the outside blade unit by elastically deforming the outside blade holder.

3. The reciprocation type electric shaver in accordance with claim 1, wherein the coupling structure comprises a hooking groove extending in the longitudinal direction on opposite inner faces of the outside blade holder, and the retaining structure comprises a hooking piece located at each longitudinal side of the slit blade to engage with the hooking groove in the heightwise direction; and the fitting recesses are located on both sides of the hooking piece.

4. The reciprocation type electric shaver in accordance with claim 1, wherein a pair of spring support bosses are provided on the outside blade holder to support floating springs which urge the slit blade upward to enable the floating.

5. The reciprocation type electric shaver in accordance with claim 3, wherein the outside blade of the main blade is held on an inside blade holder and the inside blade holder is positioned in the outside blade holder adjacent the hooking groove to reduce ratting of the slit blade.

6. The reciprocation type electric shaver in accordance with claim 1, wherein a protrusion is formed on the slit blade to prevent rattling of the slit blade with respect to the outside blade holder.

7. The reciprocation type electric shaver in accordance with claim 4, wherein a pair of holes is provided on the outside blade holder adjacent the spring support bosses to prevent debris from piling up at the slit blade.

* * * * *